United States Patent [19]

Vogel et al.

[11] Patent Number: 4,461,719

[45] Date of Patent: Jul. 24, 1984

[54] LAMELLAR CARBON-NITROSYL OR NITRONIUM SALT COMPOSITIONS

[75] Inventors: F. Lincoln Vogel, R.D. 3, Whitehouse Station, N.J. 08889; William C. Forsman, Swarthmore, Pa.

[73] Assignee: F. Lincoln Vogel, White House Station, N.J.

[21] Appl. No.: 475,368

[22] Filed: Mar. 14, 1983

[51] Int. Cl.[3] ..... H01B 1/04

[52] U.S. Cl. ..... 252/503; 252/500; 252/506; 252/507; 252/511; 423/445; 423/448; 106/20

[58] Field of Search ..... 252/503, 500, 506, 507, 252/511, 512, 518; 106/20, 23; 423/445, 447.1, 447.2, 448, 460; 260/429 R, 429 AR, 429.3, 429.5, 438.1, 439 R, 440, 446

[56] References Cited

U.S. PATENT DOCUMENTS

| | | | |
|---|---|---|---|
| 3,409,563 | 11/1968 | Okstowski | 252/506 |
| 3,950,262 | 4/1976 | Lalancette | 252/447 |
| 3,962,133 | 6/1976 | Rodewald | 252/429 R |
| 3,984,352 | 10/1976 | Rodewald | 252/433 |
| 4,046,950 | 9/1977 | Isett | 252/500 |
| 4,128,499 | 12/1978 | Cohen | 252/433 |
| 4,206,276 | 6/1980 | Basu et al. | 252/518 |

*Primary Examiner*—J. L. Barr

*Attorney, Agent, or Firm*—Kenyon & Kenyon

[57] ABSTRACT

Electrically conductive carbon compositions are disclosed which are formed from carbon having a graphite-like structure and a nitrosyl or nitronium salt or salts. The nitrosyl or nitronium salt reacts with the carbon to intercalate it with charge-exchange atoms or molecules. Binary, ternary and multi-intercalated lamellar compositions are produced according to the particular reaction process selected. The compositions may be used alone as electrical conductors or may be combined in a matrix to form composite conductors.

29 Claims, 6 Drawing Figures

LAMELLAR CARBON-NITROSYL OR NITRONIUM SALT COMPOSITIONS

This is a division of application Ser. No. 221,013 filed Dec. 29, 1980, now U.S. Pat. No. 4,382,882.

BACKGROUND OF THE INVENTION

The present invention relates to an electrically conductive lamellar carbon composition. More specifically, it relates to a composition of carbon of a graphite-like structure which has been intercalated with nitronium or nitrosyl salts.

It has long been known that the unique crystalline structure of carbon having a graphite-like form makes it anisotropic with respect to conducting electrons. Its structure basically comprises stacked planes of aromatically bound carbon atoms. Hence, above and below each of such planes are the $\pi$ bonded electrons. These electrons have been said to contribute to the anisotropic conductive behavior, the conductivity being in a direction parallel to the aromatic carbon planes. This conductivity is approximately 5% that of copper.

Several compounds which show an increase in conductivity over that of graphite and graphite-like forms of carbon have been described in the literature. Ubbeholde, for example, has found that the intercalated compound formed from graphite and nitric acid has a conductivity somewhat similar to that of copper ($0.6\times10^6$ ohms $cm^{-1}$) when measured parallel to the aromatic planes (A. R. Ubbeholde, *Proc. Roy. Soc., A*304,25, 1968). Oltowski has similarly found that interaction of vermicular graphite with halogen compounds and compression to a high density structure produces a moderately conductive material [U.S. Pat. No. 3,409,563]. Further intercalation compounds include La Lancette's preparation of graphite intercalated with antimony pentafluoride [U.S. Pat. No. 3,950,262]; Cohen's Lewis acid-fluorine intercalation compounds of graphite [U.S. Pat. No. 4,128,499] and Rodewald's Lewis acid intercalation compounds of graphite [U.S. Pat. Nos. 3,984,352 and 3,962,133].

The conductivity of these intercalated compounds, however, is less than is theoretically possible. The neutral and charged forms of the intercalating agents used as starting materials are in chemical equilibrium and therefore produce intercalation compounds that have both neutral molecules and charged molecules in the interplanar spaces. The neutral molecules do not affect conductivity. Hence, the actual conductivity is derived from the charged form which is present in a lower amount than the amount of agent incorporated.

Therefore, it is an object of the invention to produce an intercalation or lamellar composition of carbon of a graphite-like structure which contains an increased proportion of charged intercalating molecules and through which electrons can move with increased ease. Another object of the invention is to employ a reaction process which allows fast production of the lamellar composition and will permit purification without deintercalation. A further object is to produce lamellar compositions which contain more than one type of charged intercalating molecule.

SUMMARY OF THE INVENTION

These and other objects are achieved by the present invention which is directed to an electrically conductive, lamellar carbon composition, to a process for preparing a lamellar carbon composition of the present invention, an electrically conductive composite made from a carbon composition of the invention and a metal, or inorganic or organic matrix, and an electrically conductive ink or coating made from a carbon composition of the invention, a fluidizing vehicle or carrier and a binding vehicle. The compositions of the present invention may also be used as catalysts for isomerization of organic compounds, hydrocarbon cracking, polymerization of organic compounds and organic exchange reactions.

The electrically conductive, lamellar carbon compositions of the present invention comprise carbon having a graphite-like structure which has been intercalated with one or more nitrosyl or nitronium salts selected from NOX and $NO_2X$ wherein X is a stable anion.

The anion, X, is the stable, conjugate anion of any atom or molecule that is electrophilic or is a Lewis Acid. Such anions include but are not limited to a halide anion, oxyhalide anion, bisulfate anion, nitrate anion, boron halide anion, a stable halide anion of a first, second or third transition series metal, a halide anion of a group IVa metaloid or a halide anion of a group Va metaloid. Examples of anions which may be used to form the nitrosyl or nitronium salts include $SbF_6^-$, $PF_6^-$, $TaF_6^-$, $AsF_6^-$, $NbF_6^-$, $VF_6^-$, $SiF_6^{-2}$, $SiF_5^-$, $TiF_5^-$, $FeF_5^-$, $PtF_5^-$, $HfF_5^-$, $ZrF_5^-$, $FeCl_4^-$, $CoCl_4^{-2}$, $BF_4^-$, $NiF_4^{-2}$, $CuCl_4^{-2}$, $ClO_3^-$, $ClO_4^-$, $HSO_4^-$, and $NO_3^-$. Other stable analogs will be apparent from the similarity to the examples provided. Preferred anions include $SbF_6^-$, $PF_6^-$, $AsF_6^-$, $HfF_5^-$, $SiF_5^-$, $BF_4^-$, and $FeCl_4^-$.

A preferred composition is graphite-like carbon intercalated with one of these salts, or graphite-like carbon intercalated sequentially or simultaneously with two of these salts. Three or more salts may also be used in any sequence or simultaneously.

Any form of carbon which has a graphite-like, stacked plane crystalline form will suffice as the carbon starting material. Preferred forms include crystalline, vermicular, powdered and filament graphite.

A preferred form of a lamellar composition of the invention is the filament form where graphite fiber or filament has been used as a starting material.

The electrically conductive composites of the present invention are combinations of the lamellar compositions and metals, organic polymers or inorganic polymers. When the composite is a metal-composition combination, the metal may be any metal that is conductive. Preferred characteristics of the metal include flexibility, strength and inertness. The metal-composition composites may have any manner of form which provides intimate contact of the metal and composition. Preferred forms include a wire having a composition core and an outer surface of metal; a rod of compressed metal and composition particles and a strand of composition filaments and metal wire.

When the composite of the invention is a combination of an organic or inorganic polymer and a composition, the organic or inorganic polymer may be any resinous material that effectively binds the composition in a matrix and is inert. The polymer-composition composites may have any manner of form and polymer-composition ratio which provide continuous, oriented contact of the composition. Preferred forms include a fiber or shaped article having a composition core and an outer surface of polymer, a fiber matrix of composition dispersed in polymer, composition fibers in epoxy matrix, a shaped article of composition dispersed in a polymer matrix and an amorphous, fluid or gelled mixture of composition and polymer which is thermosetting, thermoplastic or tacky.

The electrically conductive inks or coatings of the present invention are composites of a composition, binder vehicles and carriers or fluidizing vehicles. The concentration of the composition must be sufficient to provide intimate contact of the composition in the binder matrix when in the dried state.

The preferred process of the invention requires that the nitrosyl or nitronium salt be dissolved in a dry, polar, aprotic organic solvent. Carbon having a graphite-like structure is then added under dry conditions to produce the lamellar composition. Sequential treatment with two differing solutions of nitrosyl or nitronium salt or simultaneous treatment with a solution containing two differing salts will produce the ternary lamellar composition. In addition, the lamellar compositions are also produced by exposure of carbon having a graphite-like structure to the nitrosyl or nitronium salt vapor under conditions familiar to those skilled in the art.

BRIEF DESCRIPTION OF THE DRAWINGS

FIGS. 1 through 6 depict the data from physical measurements of the compositions of Examples 1 through 3.

FIG. 1 shows the X-ray diffractograms for the Stage II through V compositions of Example 1.

FIG. 2 shows the X-ray diffractograms for the Stage II through IV and VI compositions of Example 2.

FIG. 3 shows the X-ray diffractograms for the Stage I through III and V compositions of Example 3.

FIG. 4 shows the curve of resistivity as a function of stage for the compositions of Example 1.

FIG. 5 shows the curve of resistivity as a function of stage for the compositions of Example 2.

FIG. 6 shows the curve of resistivity as a function of stage for the compositions of Example 3.

DETAILED DESCRIPTION OF THE INVENTION

Figure 1:
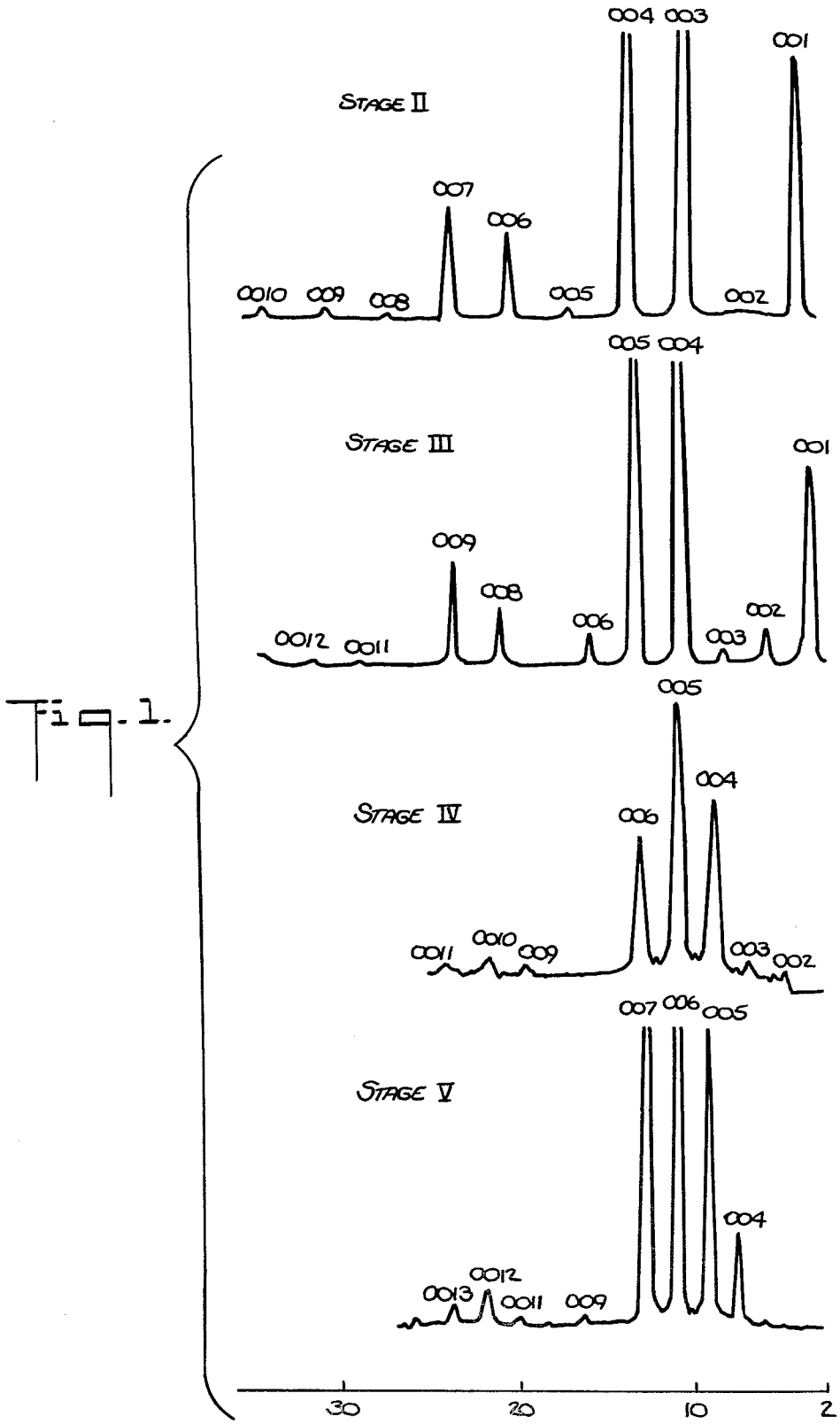

Carbon of a graphite-like structure, which is the starting material, may be in the form of large crystals, crystalline powder, carbon or graphite filaments, powdered carbon, bulk or sintered graphite or in any other form in which carbon is aromatically bound and has a crystal structure of stacked parallel planes. Generally, the more perfect the crystallinity of the starting material is, the better the conductivity of the resultant composition. Hence, it is preferable to employ graphite-like carbon of relatively high purity and which has a high degree of crystallinity. However, satisfactory results have been obtained with lower degrees of purity and crystallinity. In the case of carbon filaments and powdered carbon, the structure of the material is preferably altered to stacked parallel planes by known methods prior to intercalation.

The nitrosyl or nitronium salts act as oxidizing agents and convert some of the carbon atoms at the edge surface of each crystal plane of the carbon starting material to carbonium ions. The anion of the salt becomes the corresponding gegenion and the nitrosyl or nitronium ion is reduced to nitric oxide or nitrogen dioxide respectively. Irrespective of this mechanism, however, it is the anion, X, which is the primary intercalation species, acts as an electron acceptor species and acts with the carbonium ions to create the improved conductivity of the lamellar compositions. Accordingly, X may be any negatively charged atom or molecule that is stable, forms salts with nitrosyl or nitronium ions and has atomic dimensions that will permit intercalation. Such a species typically is the conjugate anion of an atom or molecule that is electrophilic or is a Lewis acid. Examples and preferred specifies are given above.

The lamellar compositions of the present invention are structurally arranged as stacked planes of aromatically bonded carbon atoms between which are located the negatively charged molecules or atoms (X). This arrangement is herein termed intercalation and X is herein termed the intercalation species.

Several macrocrystalline intercalation structures are possible and all of these are included within the invention. For example, the crystal lattice may be repeating units composed of the sequence [carbon plane, intercalation species]; or the sequence [carbon plane, carbon plane, intercalation species]; or the sequence [carbon plane, carbon plane, carbon plane, intercalation species]. Other similar repeating units are also possible.

Such repeating units are termed stages and may be experimentally determined from X-ray diffractograms of the compositions using techniques known to those skilled in the art. The first exemplified unit is stage 1, the second is stage 2, the third is stage 3. Other stages correspond to the other similar sequences. All such staged compositions are included within the invention.

In addition to the staged compositions, non-staged compositions having random or nonspecifically dispersed intercalating species are also possible and are included within the invention. Such compositions result, for example, by exfoliation of a staged composition to produce a composition having randomly defective intercalating species levels.

The compositions of the present invention are preferably formed by solution reaction of the carbon starting material and the nitrosyl or nitronium salt. The salt is dissolved in a polar, aprotic organic solvent, typically to produce a saturated concentration. The carbon is then added to the solution or the solution is added to the carbon and the intercalation reaction is conducted at a temperature of from about ambient to about 90° C. for about 10 minutes to about 30 hours or until the desired stage of intercalation is achieved. The rate of reaction increases with increases in the concentration of salt and the temperature.

The reaction must be conducted under anhydrous conditions which typically will be accomplished through use of a self-contained, inert atmosphere glove box or closed system reaction apparatus.

The relative amount of intercalation may be monitored by the contactless technique of Zeller et al., *Rev. Sci. Inst.* 50, 71 (1979); *Materials Sci. and Eng.* 31, 255 (1977); which allows measurement of electrical conductance and volume resistivity of the carbon during reaction.

The polar, aprotic organic solvents include those in which the nitrosyl or nitronium salts are soluble. Typical examples include tetramethylene sulfone (sulfolane), dimethyl sulfoxide, nitromethane, nitroethane and the like.

In saturated salt solution, the concentration of which will depend upon the solvent, stage 1, 2 and 3 lamellar compositions are typically obtained in about 15 minutes to about 12 hours. Dilute solutions of the salt, i.e., about 0.5 to about 20 weight percent salt in the solvent which are typically made by doubling the solvent volume of a saturated solution, will require weeks to produce these rich stage lamellar compositions. Accordingly, the desired stage of lamellar composition may be selected by variation of the salt concentration in solution. Dilute solutions will produce the higher stage compositions, e.g., stages 6–10, within from about 10 minutes to about 24 hours while saturated solutions will produce the lower stages within this time period.

The compositions of the present invention may also be prepared by gas-solid phase reaction. The carbon is exposed to the salt vapor produced by an isolated volume of liquid or solid salt. The gas-solid phase reaction parameters, such as pressure, gas volume, temperature and density are controlled and selected by methods known to those in the art. Continued exposure, monitored by the above mentioned stage monitoring techniques, will produce the desired lamellar compositions. Nonstaged compositions can also be prepared by appropriate modification of the gas-solid phase reaction parameters.

Ternary or higher lamellar compositions of the present invention are those which have been intercalated with two or more nitrosyl or nitronium salts. Depending upon the reaction procedure employed, the macrocrystalline structure may be of several forms. For example, the lattice may be repeating units of [carbon plane, first intercalation species, carbon plane, second intercalation species] or may be repeating units of [carbon plane, mixture of first and second intercalation species]. Other arrangements of repeating units are also possible and are apparent from the statistical variations of carbon planes and intercalation species.

The arrangement is a function of simultaneous or sequential reaction of the salts and the carbon, the molar ratios of the salts and the stage to which intercalation is allowed to proceed. For example, sequential reaction first with nitronium hexafluoroantimonate to produce a stage 2 composition and then with nitronium hexafluorophosphate will produce a composition having the first type of repeating lattice unit mentioned above, e.g., [carbon plane, hexafluoroantimonate, carbon plane, hexafluorophosphate]. Simultaneous reaction to a stage 1 composition will produce the second type of repeating unit mentioned above.

Nonstaged lamellar compositions which are multi-intercalated are also possible and are included within the invention. Random dispersion of multiple intercalating species by exfoliation, deintercalation, random reaction or use of impure carbon will produce such nonstaged compositions.

The metal-composition composites of the present invention can be prepared from any of a number of desired metals and the particular metal employed is restricted solely by the intended application of the composite. Copper is deemed preferable for most applications, but excellent results are also obtained from silver, aluminum and nickel. It is advantageous from a structural standpoint to utilize metals such as zinc and cadmium which form a hexagonal lattice structure. Such metals are particularly compatible with the hexagonal lattice structure of graphite in that advantageous reorientation can be achieved during the deformation stage of the preparation of the composite.

Several methods can be employed in preparing the metal-composition composite. If the composition is in filament form, a plating technique can be employed. Hence, composition filaments which have been thoroughly washed and dried are made the cathode in a metal plating solution. This process can be batchwise, in which case an electrode is attached to one end of a yarn which is submerged in the plating solution. Alternatively, the metal-composition composite can be made continuously by passing the strands of composition yarn over a metal electrode and into the plating bath. Residence times and other reaction conditions are easily determinable by one of reasonable skill in the art, and such reaction parameters are functions of the particular plating bath, cathode current, composition yarn conductivity, cross-sectional area and the like.

Another method of forming metal-composition composites involves twisting metal strands or wires with composition filaments. Hence, it is possible to vary greatly the physical and electrical properties of composites by varying the ratio of metal to graphite strands and by choosing strands of a particularly suitable metal.

A powdered composition of the present invention can also be formed into a metal-composition composite by a compression process. The powdered composition is thoroughly mixed with a powder of the desired metal and the mixture is compressed at pressures in the range of about 10 to 100,000 psi. The exact pressure will be dependent upon the specific metal employed. With copper powder having an average particle size of 60 microns, a pressure of about 60,000 psi is typical. The compression step is followed by annealing at temperatures of about 250° to 1000° C. in a hydrogen atmosphere.

The ratio of metal to composition in the compression process is not critical, but the resultant composite preferably will contain as much composition as possible. However, when the metal phase becomes discontinuous, the mechanical strength of the composite is seriously impaired. Continuity of the metal phase typically will be ensured by employing about 30 percent composition by volume. This amount permits the use of a wide range of particle sizes; however, optimum mechanical strength is obtained when fine metal particles are employed. Moreover, higher amounts of composition will require the finer metal particles to ensure metal continuity.

This process is adaptable to well-known powder metallurgy techniques and the resultant metal-composition composite can readily be converted into wire or other suitable forms.

Another method for formation of a metal-composition composite which is especially suitable for powdered composition is the "sheath process". In this method, a tube of the appropriate metal, such as 7 mm copper tubing, is filled with the composition powder. The powder is lightly tamped. Excessive packing of the powder hampers electrical orientation of the graphite and is to be avoided. When full, the tube is preferably sealed and subjected to swaging. Typically a 7 mm o.d. copper tube, filled with the graphite powder is swaged down to a diameter of about 1 mm by means of a Torrington Swaging Mill. The resultant metal-composition composite comprises 1 mm wire having excellent physical and electrical properties.

The polymer-composition composites of the present invention can be prepared from polymeric matrix materials such as thermosetting resins, thermoplastic resins, gelling resins, fibrous resins, tacky resins and other similar resins that are compatible with carbon. Physical characteristics include strength and ability to form uniform dispersions. Depending upon the application of the composite, the resins may be flexible or rigid, may remain solid or become fluid at high temperature, may maintain flexibility at low temperature, be of high or low density, and be extrudable, moldable, pressable, malleable or shapeable. Other common polymer characteristics are also included. Examples of the organic polymers include polyesters, polyamides, polyethers, polyorganocarbonates, polyolefins, polytetrafluoroethylenes, polyglycols and other similar organic polymers. Examples of inorganic polymers include polysilicones, polysilicates, silicate glasses, borosilicate glasses, aluminosilicate glasses, polyfluorosilicones, polyfluorosilicates, polysiliconitrides and other similar silicon based polymers, fibrous compositions of asbestoes, mica and other similar mineral compositions that will form uniform dispersions with the compositions and allow intimate, continuous contact of the composition particles.

Fabrication can be accomplished by mixing the composition with the polymer in a fluid state or in solution followed by binding, molding, heating, cooling, injecting, hardening or otherwise forming the composite structure. The composition may also be mixed with the monomeric material and the mixture polymerized according to methods known to those in the art. Other known methods of polymer processing may also be used. The polymers may be in the form of flakes, powder, fibers, liquid, viscous slurry, tacky solid or dissolved in a carrier. The compositions may be in any of the forms described above. When the polymer is in a solid form, pressing, milling, rolling, dissolving in a solvent or other similar processes can be used to prepare the polymer-composition composites.

After formation of a polymer-composition composite, it will typically have the physical characteristics of the polymer and highly increased electrical conductance. Typical applications include plastic conductors, wires and fibers, shaped articles such as aircraft surfaces, electronic equipment housings, insulating shields and other large or small pressed, molded or shaped articles where shielding, grounding, static electricity build-up or magnetic fields may be a concern. Other applications include appliance housings, machine housings, machine tokens, adhesives, glues, binders for electrical conduction and other similar items.

The inks and coatings composites of the present invention are used to create a means for electrical conductance on surfaces. They may take the form of a single, uniform line, a multitude of interconnecting or non-connecting lines, an arrangement connecting electronic components or a film or coating on the entire surface. The inks are dispersions of the composition in a vehicle binder and fluid carrier. When applied to the surface to be inked, the ink dries into a flexible or rigid film by carrier evaporation, precipitation of the binder vehicle, polymerization of the binder vehicle or other known inking processes. The character of the film is determined by the type of binder used and will consist of a uniform dispersion of the composition in the binder at a concentration that will permit intimate, continuous contact of the composition.

The coatings are also dispersions of composition in a vehicle binder and fluid carrier. They are generally of higher density than the inks and are used in heavy duty applications such as coatings on appliance and machine housings. They may be formulated with the typical paint and coating pigments, binders, extenders and solvents as long as the composition will be present in the dried coating at a concentration that will permit continuous contact of the composition particles.

The inks and coatings may be prepared by the known methods of formulation and preparation of typical inks and coatings. The known paint, ink and coating ingredients that do not react, interrupt or decompose the compositions may be used.

The compositions of the present invention may also be used in other applications not related to electrical conductance. They are useful as catalysts for isomerization of organic compounds, for example, conversion of n-butane into isobutane. They are useful as hydrocarbon cracking catalysts and find applications in the petroleum refining industry for conversion of high weight hydrocarbons, paraffins and aromatics to lower weight materials. They are useful as polymerization catalysts which will cause conversion of olefins to polyolefins and aromatic compounds to polyaromatics, Other similar polymerization rearrangements are also affected by the compositions. Other similar applications will come to mind and are included as uses for the compositions of the invention.

The following Examples are herein provided for illustrative purposes only. They do not constitute limitations of the present invention which is fully set forth and described above.

GENERAL METHOD FOR COMPOSITION PREPARATION

The apparatus in which the intercalation reactions are conducted is a vacuum manifold system with vacuum valve joints for a solvent flask and a nitrosyl or nitronium salt flask. A side arm tube is connected to the salt flask and serves as the container for the carbon and as the reactor vessel. The side arm tube is of a size, configuration and arrangement that X-ray studies and resistivity measurements can be made without removing the composition product from the reaction vessel.

When ternary or higher compositions are synthesized, the salt flask is a multichambered vessel with vacuum valves positioned so that each chamber can be isolated from the rest of the system and from the common chamber. The reactor vessel is connected to the common chamber of the salt flask. The various salts are placed in the individual vessels and sequential intercalation is achieved by appropriate manipulation of the chamber isolating valves and the reactor vessel. Alternatively, a single salt flask, reactor vessel arrangement can be used by removing the salt solution after the first desired intercalation stage is reached, recharging with the second salt and repeating the process. Simultaneous intercalation to produce ternary or higher compositions can be conducted in the single salt flask-reactor vessel apparatus.

Highly oriented pyrolytic graphite (HOPG) is typically used as the carbon starting material. It is a large crystalline form which can be wire saw cut and cleaved into pieces suitable for intercalation in the above described apparatus. A typical cut and cleaved size is 0.5 cm$\times$0.5 cm$\times$0.25 mm.

The entire apparatus and the starting materials are contained within an inert atmosphere glove box which maintains the required dry atmosphere. The nitrosyl or nitronium salt or salts and the HOPG are introduced into the reactor inside the glove box. The apparatus is then connected to a vacuum line and the HOPG and the salt or salts are carefully outgassed with a torch and in an oil bath, respectively.

When the outgassing is complete, rigorously purified and dried nitromethane or other organic solvent is placed in the solvent flask and thence distilled through manifold into the flask containing the salt or salts. The solution of dissolved salt and solvent is discharged onto the HOPG. Initial contactless resistivity measurements which may then be made in situ will show that the contribution of the conductivity of the solution above that of HOPG is negligible. When nitronium salts in solution are used, the reaction of the HOPG and the salt starts quickly and a brown gas, nitrogen dioxide, is evolved. The rate of the reaction may be controlled by diluting the salt solutions to varying concentrations. The salt flask is calibrated in graduations to allow determination of the concentration. After the reaction has reached the desired stage, typically as shown by monitoring the progress with contactless resistivity measurements and X-ray diffraction, the solution is removed and the composition material is washed with fresh solvent to remove excess salt. No substantial deintercalation occurs as a result of this work-up as is shown by maintenance of the same conductivity before and after the work-up. Unless otherwise specified, the reactions are conducted at ambient temperature. Weight uptake and thickness are typically measured for HOPG samples at welldefined stages.

EXAMPLE 1

Graphite Tetrafluoroborate Composition

Using the above general method, graphite tetrafluoroborate compositions were prepared from HOPG and nitronium tetrafluoroborate in nitromethane at ambient temperature. The graphite tetrafluoroborate compositions of stages 2 to 7 were obtained by reaction of HOPG and a saturated (about 10 wt. %) nitronium tetrafluoroborate, nitromethane solution for from 15 minutes to 10 hours as shown by contactless resistivity and X-ray monitoring. Higher stage compounds were obtained by the reaction of HOPG and dilute (about 5 wt. %) nitronium tetrafluoroborate dissolved in tetramethylene sulfone. Here, the passage from lean stage 10 to rich stages is slow and gradual usually requiring several weeks. FIG. 1 represents X-ray diffractograms obtained for the composition of stages 2, 3, 4 and 5. The identity period $I_c$ is equal to $7.90+(n-1)3.55$ Å, where n is the stage of the composition.

EXAMPLE 2

Graphite Hexafluorophosphate Compositions

Figure 2:
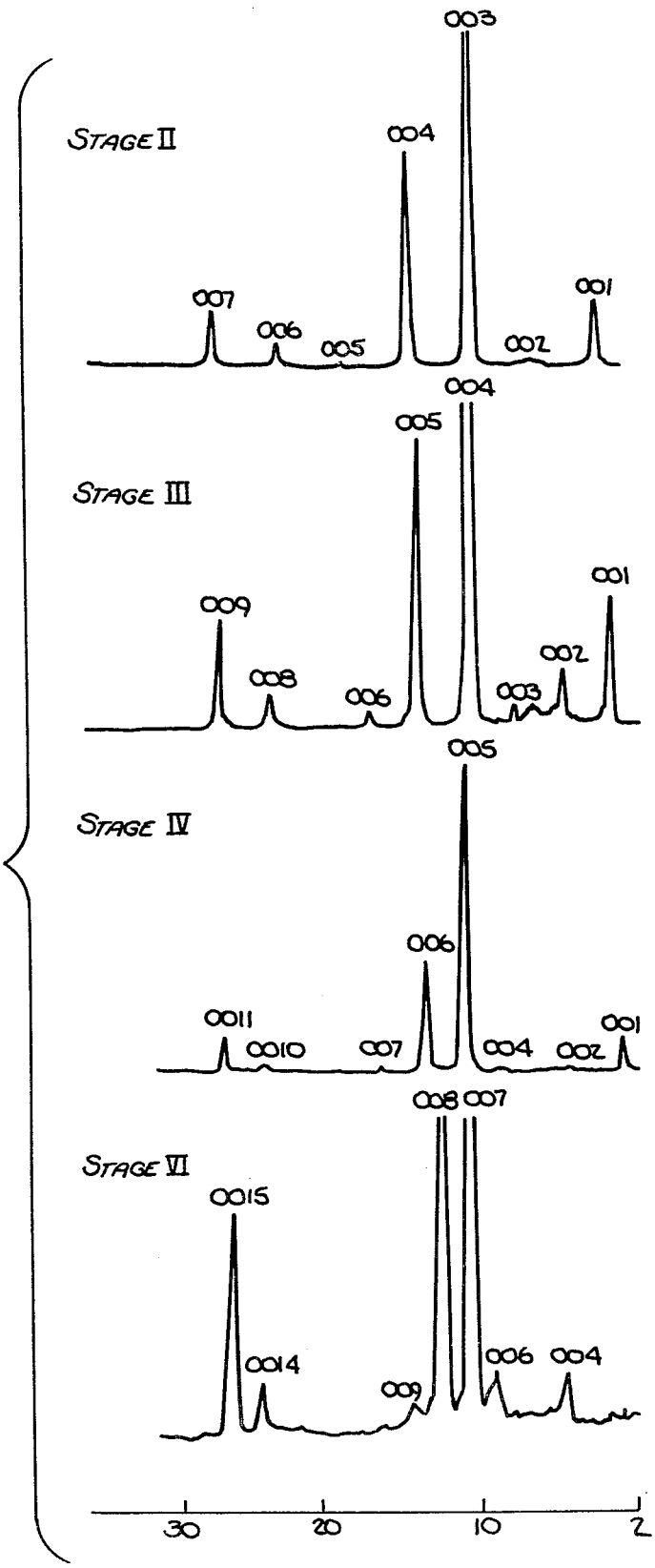

Graphite hexafluorophosphate compositions of stages 2 to 8 were synthesized using the above general method. The reaction of HOPG and about 10 wt. % nitronium hexafluorophosphate in nitromethane solution (saturated) resulted in the formation of the (stage 2) blue-black composition in 12 hours at ambient temperature. The nitronium hexafluorophosphate solution diluted to twice the volume with nitromethane led to a gradual intercalation and produced the higher stage compositions. FIG. 2 presents the X-ray diffractograms of the compositions of stages 2, 3, 4 and 6. The identity period is $I_c=7.75+(N-1)3.35$ Å.

A chemical analysis of the stage 2 graphite hexafluorophosphate composition was performed. The theoretical formula is $C^{+}_{48}PF_6^{-}(CH_3NO_2)$.

| | C | H | N | F | P |
|---|---|---|---|---|---|
| calc'ed % | 71.0 | 0.3 | 3.3 | 13.5 | 3.6 |
| actual % | 69.60 | 0.02 | 2.82 | 14.98 | 3.60 |

This analysis demonstrates that the intercalation species is present as hexafluorophosphate anion and not as pentafluorophosphate.

EXAMPLE 3

Graphite Hexafluoroantimonate Compositions

Figure 3:
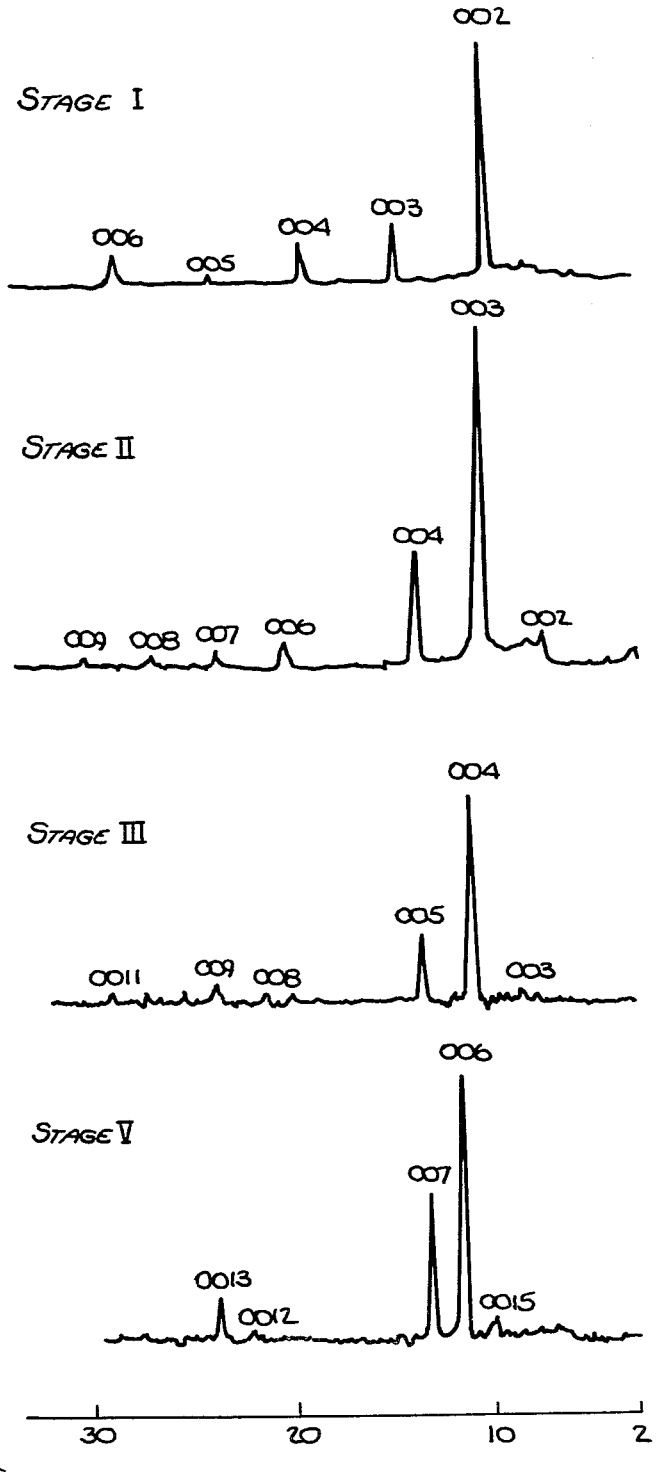

Graphite hexafluoroantimonate compositions were produced under the same experimental conditions as described above. The compositions of second and first stages were obtained in 15 minutes and 12 hours, respectively, in nitromethane saturated with nitronium hexafluoroantimonate (about 10 wt. %) at ambient temperature. Stages 1 to 8 have been identified and FIG. 3 shows the X-ray diffractograms obtained for compositions of stages 1–5. The identify period determined by radiocrystallographite measurements is equal to $I_c=8.05+(n-1)3.35$ Å.

EXAMPLE 4

Thickness Measurements for Some Compositions of Examples 1, 2 and 3

The relative increases in thickness measured on the lowest stage compositions of Examples 1, 2 and 3 are comparable to the dilations deduced from radiocrystallographite analysis. The comparative data are presented in Table 1. Weight uptake is also given in the table but is of limited precision because of the small masses involved.

TABLE 1

| Correlation of Stage by X-Ray, Thickness and Weight Change Data | | | | | |
|---|---|---|---|---|---|
| | | | Relative Expansion ($\Delta l/l$) | | Relative Weight |
| Comp. Ex. | Comp. Stage | Id Period I Angstroms[c] | From Thickness | From X-Ray | Uptake ($Am/m_o$) |
| 1 | 2 | 11.25 | 0.70 | 0.68 | 0.4 |
| 1 | 3 | 14.58 | — | 0.45 | — |
| 2 | 2 | 11.10 | 0.79 | 0.66 | 0.5 |
| 2 | 2 | 14.44 | — | 0.44 | — |
| 3 | 1 | 8.05 | 1.45 | 1.40 | 1.2 |
| 3 | 1 | 11.38 | 0.72 | 0.70 | 0.7 |

EXAMPLE 5

Resistivity Measurement of Some Compositions of Examples 1, 2 and 3

Using the r.f. induction technique for measuring resistivity by a contactless method which was reported by Vogel et al. in *Carbon* 17, 255 (1979), the resistivities of the various stages the compositions of Examples 1–3 were measured in situ. The results obtained are presented in Table 2. The results are also plotted as curves in FIGS. 4, 5 and 6. These curves represent the variation of a-axis resistivity as a function of stage of the compositions of each Example. The general shape of the curve is the same for the three Examples, the lowest resistivity values being found for the stage 5 composition in each Example. Very low values, approaching the resistivity of copper, were found for stages IV and VI compositions of Example 3 (Graphite Hexafluoroantimonate). A considerable difference exists in the values measured for compositions of the same stage and Example but which were prepared for HOPG of uneven quality. Furthermore, measurements made after transfer to a dry box show a notable increase of the in-plane resistivity, probably due to impurities in the gas.

TABLE 2

Electrical Resistivity of the Graphite Tetrafluoroborate, Hexafluorophosphate and Hexafluoroantimonate Composition of Examples 1-3

| Composition | Stage | $\rho_o$ | $\rho_{cx}$ | $\rho/\rho_o$ | Symbol | Remarks |
|---|---|---|---|---|---|---|
| (Graphite Tetrafluoroborate) | 2 | | 3.9 | 0.10 | • | N.M. |
| | 2 | 38.9 | 4.3 | 0.11 | | N.M. |
| | 3 | 38.6 | 3.8 | 0.10 | ○ | N.M. |
| | 4 | 38.6 | 3.5 | 0.09 | | |
| | 4 | 37.0 | 3.9 | 0.10 | □ | T.M.S. |
| | 5 | 38.6 | 3.5 | 0.09 | ⊙ | |
| | 5 | 37.0 | 3.8 | 0.19 | □ | T.M.S. |
| | 6 | 38.6 | 3.9 | 0.19 | ⊙ | N.M. |
| | 6 | 37.0 | 4.1 | 0.11 | □ | T.M.S. |
| | 7 | 38.6 | 4.2 | 0.11 | ⊙ | T.M.S. |
| | 9 | 38.6 | 7.0 | 0.18 | ⊙ | N.M. |
| (Graphite Hexafluorophosphate) | 2 | 34.8 | 3.5 | 0.10 | ⊗ | N.M. |
| | 2 | 37.2 | 3.6 | 0.10 | ○ | N.M. |
| | 2 | 37.8 | 3.7 | 0.10 | □ | N.M. |
| | 2 | 37.9 | 4.0 | 0.11 | □ | N.M. ($N_2$) |
| | 3 | 36.3 | 3.3 | 0.09 | • | N.M. |
| | 4 | 36.3 | 2.2 | 0.06 | • | N.M. |
| | 4 + 5 | 39.2 | 2.5 | 0.06 | Δ | N.M. |
| | 6 | 36.3 | 2.1 | 0.06 | • | N.M. |
| | 6 | 39.2 | 2.5 | 0.06 | Δ | N.M. |
| | 4 + 7 | 39.2 | 2.7 | 0.07 | Δ | N.M. |
| | 7 + 8 | 36.3 | 3.3 | 0.09 | • | N.M. |
| | 8 | 39.2 | 3.1 | 0.08 | Δ | N.M. |
| | 8 + 9 | 39.2 | 4.7 | 0.12 | Δ | N.M. |
| | 9 | 36.3 | 6.3 | 0.16 | • | N.M. |
| | 9 | 39.2 | 5.1 | 0.13 | ▲ | N.M. |
| (Graphite Hexafluoroantimonate) | 1 | 38.3 | 4.6 | 0.12 | ⊘ | N.M. |
| | 1 | 36.3 | 4.0 | 0.11 | • | N.M. |
| | 2 | 36.6 | 4.0 | 0.11 | ○ | N.M. |
| | 2 | 38.6 | 4.3 | 0.11 | ⊗ | N.M. |
| | 3 | 36.3 | 3.4 | 0.09 | • | N.M. |
| | 3 + 4 | 36.6 | 2.8 | 0.08 | ○ | N.M. |
| | 4 | — | 3.0 | 0.08 | ○ | N.M. |
| | 5 | — | 2.5 | 0.07 | ○ | N.M. |
| | 6 | — | 3.0 | 0.08 | ○ | N.M. |
| | 7 | — | 3.3 | 0.09 | ○ | N.M. |
| | 8 | — | 4.1 | 0.11 | ○ | N.M. |
| | 9 | — | 4.7 | 0.13 | ○ | N.M. |

N.M. — nitromethane
T.M.S. — tetramethylene sulfone
($N_2$) — transfer under $N_2$ atmosphere
$\rho_o$ — initial resistivity in $\times 10^{-6}$ ohm cm of graphite crystal HPOG
$\rho_{cx}$ — resistivity of the composition at the stage indicated, in $\times 10^{-6}$ ohm cm.
symbol — the plot symbol used in FIGS. 4, 5 and 6

EXAMPLE 6

Effect of Temperature and Time on Graphite Tetrafluoroborate Formation

Using the above general method and the measurement methods of Example 5, the effects of temperature and time upon the formation of graphite tetrafluoroborate were studied.

A 10 percent solution of nitronium tetrafluoroborate in sulfolane (a dilute solution) was used to intercalate HOPG crystals having the following dimensions: weights, 7-20 mg; thicknesses 0.1-0.5 mm; surface areas, 22-26 mm$^2$; resistivities, 40-50$\times 10^{-6}$ ohm cm. Two reactions were conducted, one at ambient temperature (reaction A) and the other at 40° C. (reaction B). The weight, thickness, conductivity and resistivity of the composition crystals were measured periodically while the reactions proceeded. Table 3 gives the results of reaction A and of reaction B. Shown are the increase in weight, thickness (d), electrical conductance (c) and decrease in volume resistivity (p) for the composition as a function of time. Table 4 gives ratios of thickness, conductivities and volume resistivities for unreacted HOPG and the composition after 4 hours reaction time and at the termination of the reaction.

The results provided in these tables indicate that the rate of intercalation increases with temperature. The results of Table 3 also indicate that resistivity reaches a minimum between 4 and 23 hours when the reaction is run at 40° C.

TABLE 3

Intercalation of HOPG with $NO_2BF_4$

| Reaction | Rxn. Time hours | Rxn. Temp. °C. | Weight (gms) | $C^a$ ($10^3$ ohm$^{-1}$) | $e^b$ mm | $\sigma^c$ ($10^{-6}$ ohm cm) |
|---|---|---|---|---|---|---|
| A[d] | 0 | RT | 0.0210 | 1.0 | .424 | 40.8 |
| | 1 | RT | | 1.5 | .448 | 29.0 |
| | 4 | RT | | 2.0 | .472 | 23.1 |
| | 23 | RT | .0233 | 5.4 | .520 | 9.7 |
| | 49 | RT | | 7.5 | .544 | 7.3 |
| | 192[11] | RT | .0297 | | | |
| B[f] | 0 | RT | .0143 | 0.8 | .308 | 39.5 |
| | 1 | 40 | | 1.5 | — | |
| | 3 | 40 | | 7.0 | — | |
| | 4 | 40 | | 7.8 | .495 | 6.3 |
| | 23 | 40 | | 9.2 | .643 | 7.0 |
| | 27 | 40 | | 9.0 | .638 | 7.1 |
| | 144[11] | 40 | .0261 | | | |

[a]Electrical conductance
[b]Thickness
[c]Resistivity
[d]Surface area (Length × Width) = 22.465 mm$^2$
[e]Measurements not reported, crystal exfoliated
[f]Surface area = 22.225 mm$^2$

TABLE 4

Ratios

| Reaction | Exn. Time hours | Rxn. Temp. °C. | $C_i^a/C_g$ | $e_i^b/e_g$ | $\rho_g^c/\rho_i$ |
|---|---|---|---|---|---|
| A[d] | 4 | RT | 2.4 | 1.1 | 1.8 |
| | 49 | RT | 7.2 | 1.3 | 5.6 |
| B[e] | 4 | 40 | 10.0 | 1.6 | 6.2 |
| | 23 | 40 | 11.8 | 2.1 | 5.7 |

[a]Ratio of electrical conductance of intercalated graphite to graphite
[b]Ratio of thickness of intercalated graphite to graphite
[c]Ratio of reistivity of graphite to intercalated graphite
[d]Surface area of HOPG crystal (Length × Width) = 22.46 mm$^2$
[e]Surface area of HOPG crystal = 22.22 mm$^2$

EXAMPLE 6

Effect of Temperature, Salt Concentration and Time on Graphite Hexafluoroantimonate Formation Using the above general method and the measurement methods of Example 4, a saturated solution and a 20 percent by weight solution of nitronium hexafluoroantimonate in sulfolane were used to intercalate HOPG crystals at varying temperatures. The weight of the reacting crystal, the electrical conductance and the resistivity were periodically measured while the reactions proceeded.

Table 5 gives the results of the study; reaction A is the saturated solution reaction with an HOPG crystal having a surface of 22.3 mm$^2$ and reaction B is the 20 percent solution reaction with an HOPG crystal having a surface area of 21.7 mm$^2$.

The heading explanations are as follows:

(a) For reaction A, a 20 percent solution of salt was used for the first 24 hours. This was then saturated with salt at the 24 hour mark. At the 102 hour mark, more salt was added to resaturate the solution which had become dilute as a result of the reaction.

(b) Weight of the crystal, at 0 time the weight is that of the HOPG.

(c) Ratio of weight of composition to HOPG (d) Electrical conductance (e) Ratio of electrical conductance of composition to HOPG.

(f) thickness (g) Ratio of thickness of composition to HOPG.

(h) Resistivity (i) Ratio of resistivity of compensation to HOPG

The results indicate that intercalation with a solution of nitronium hexafluoroantimonate does not proceed at a perceptible rate unless the solution is saturated. The reaction rate for a saturated solution of nitronium hexafluoroantimonate is also much slower than the rate for a saturated solution of nitronium tetrafluoroborate, see Table 3. This difference is likely due to the larger size of the hexafluoroantimonate anion.

TABLE 5

INTERCALATION OF HOPG by $NO_2SbF_6$

| Reaction | Exn. Time hrs. | Exn. Temp. °C. | Wt.[b] gms. | $W_c$[c] / $W_g$ | C[d] mV | $C_c$[e] / $C_g$ | e[f] mm | $e_c$[g] / $e_g$ | $\rho$[h] $10^{-6}$ ohm cm | $\rho_g$[i] / $\rho_c$ |
|---|---|---|---|---|---|---|---|---|---|---|
| A | 0 | RT | .0141 | | 0.46 | | .286 | | 37.7 | |
| | 24 | 50 | | | 0.46 | 1 | | | | |
| | 26 | 60 | | | 0.97 | 2.1 | | | | |
| | 30 | 60 | | | 1.60 | 3.5 | | | | |
| | 48 | 60 | | | 2.02 | 4.4 | | | | |
| | 52 | 60 | | | 2.09 | 4.5 | | | | |
| | 76 | 75 | .0187 | 1.34 | 2.22 | 4.8 | .398 | 1.33 | 10.9 | 3.5 |
| | 102 | 75 | | | 5.80 | 12.6 | | | | |
| | 126 | 75 | | | 5.64 | 12.3 | | | | |
| | 150 | 75 | .0302 | 2.14 | 5.53 | 12.0 | .643 | 2.25 | 7.1 | 5.4 |
| B | 0 | RT | .0126 | | 0.39 | | .260 | | 38.4 | |
| | 24 | 50 | | | 0.47 | 1.2 | | | | |
| | 26 | 60 | | | 0.49 | 1.3 | | | | |
| | 48 | 60 | | | 0.51 | 1.3 | | | | |
| | 126 | 75 | | | 0.57 | 1.5 | | | | |
| | 150 | 75 | | | 0.57 | 1.5 | | | | |

EXAMPLE 7

Graphite Tetrafluoroborate Hexafluorophosphate Composition

Using the above general method, a graphite tetrafluoroborate, hexafluorophosphate sequential composition is prepared from HOPG, nitronium tetrafluoroborate and nitronium hexafluorophosphate in nitromethane. A stage 3 graphite-tetrafluoroborate composition is first prepared following the method of Example 1. The nitronium tetrafluoroborate solution is then removed from the salt flask and the composition material is washed with fresh solvent. The washings are discharged. Nitronium hexafluorophosphate is added to the salt flask, nitromethane is added to form a saturated solution and the solution is poured into the reaction vessel to contact the above stage 3 composition. The reaction is continued until the stage 2 composition of the above identity is produced. After work up, volume resistivity, conductivity, thickness and X-ray diffraction measurements may be made directly upon the composition crystal in the reaction vessel. Such measurements will demonstrate that the ternary compositions have superior conductivity properties.

What is claimed is:

1. A process for the preparation of a electrically conductive lamellar carbon composition, comprising carbon having a graphite-like, stacked-plane-crystalline form intercalated with one or more nitrosyl salts selected from NOX or nitronium salts selected from $NO_2X$ wherein X is a stable, conjugate anion of an electrophilic atom, molecule or Lewis acid, which process comprises:

reacting carbon having a graphite-like, stacked-plane-crystalline form with said nitrosyl or nitronium salts dissolved in a dry, polar, aprotic solvent at about ambient temperature to about 90° C. for about 10 minutes to about 30 hours or until the desired stage of intercalation has been produced.

2. A process for the preparation of a ternary electrically conductive lamellar carbon composition, comprising carbon having a graphite-like, stacked-plane-crystalline form intercalated with two nitrosyl salts selected from NOX or nitronium salts selected from $NO_2X$ wherein X is a stable, conjugate anion of an electrophilic atom, molecule or Lewis acid, which process comprises:

reacting carbon having a graphite-like, stacked-plane-crystalline form sequentially or simultaneously with two differing salts selected from nitrosyl or nitronium salts dissolved in a dry, polar, aprotic solvent at about ambient temperature to about 90° C. for about 10 minutes to about 30 hours or until the desired stage of intercalation has been produced.

3. A process for the preparation of a binary electrically conductive lamellar carbon composition, comprising carbon having a graphite-like, stacked-plane-crystalline form intercalated with a nitrosyl salt selected from NOX or a nitronium salt selected from $NO_2X$ wherein X is a stable, conjugate anion of an electrophilic atom, molecule or Lewis acid, which process comprises:

reacting carbon having a graphite-like, stacked-plane-crystalline form with said nitrosyl or nitronium salt dissolved in a dry, polar, aprotic solvent at about ambient temperature to about 90° C. for about 10 minutes to about 30 hours or until the desired stage of intercalation has been produced.

4. A process in accordance with claim 1 further comprising the step of controlling said desired stage of intercalation by varying the concentration of said nitrosyl salts or nitronium salts in said solvent.

5. A process in accordance with claim 2 further comprising the step of controlling said desired stage of intercalation by varying the concentration of said nitrosyl salts or nitronium salts in said solvent.

6. A process in accordance with claim 3 further comprising the step of controlling said desired stage of intercalation by varying the concentration of said nitrosyl salt or nitronium salt in said solvent.

7. A process in accordance with claim 2 wherein said carbon is sequentially reacted with a first salt selected from said nitrosyl or nitronium salts to produce an intercalated intermediate having an integer intercalation stage greater than one; and said intermediate is reacted with a second salt selected from said nitrosyl or nitronium salts to produce an intercalated compound having repeating alternating layers of said first and second salts and an intercalation stage lower than that of said intermediate.

8. A process in accordance with claim 2 wherein said carbon is simultaneously reacted with first and second salts selected from said nitrosyl or nitronium salts to produce an intercalated compound having repeating layers of a mixture of said first and second salts.

9. A process in accordance with claim 1 wherein said solvent is selected from the group consisting of tetramethylene sulfone, dimethyl sulfoxide, nitromethane, and nitroethane.

10. A process in accordance with claim 2 wherein said solvent is selected from the group consisting of tetramethylene sulfone, dimethyl sulfoxide, nitromethane and nitroethane.

11. A process in accordance with claim 3 wherein said solvent is selected from the group consisting of tetramethylene sulfone, dimethyl sulfoxide, nitromethane and nitroethane.

12. A process in accordance with claim 1 wherein said carbon is sequentially intercalated with more than two of said salts.

13. A process in accordance with claim 1 wherein said carbon is simultaneously intercalated with more than two of said salts.

14. A process in accordance with claim 1 wherein said carbon is in the form of large crystals; crystalline powder; vermicular, powdered, filament, bulk or sintered graphite; or carbon filaments.

15. A process in accordance with claim 2 wherein said carbon is in the form of large crystals; crystalline powder; vermicular, powdered, filament, bulk or sintered graphite; or carbon filaments.

16. A process in accordance with claim 3 wherein said carbon is in the form of large crystals; crystalline powder; vermicular, powdered, filament, bulk or sintered graphite; or carbon filaments.

17. A process in accordance with claim 14 wherein X is $SbF_6^-$, $PF_6^-$, $TaF_6^-$, $AsF_6^-$, $NbF_6^-$, $VF_6^-$, $SiF_5^-$, $TiF_5^-$, $GeF_5^-$, $SiF_6^{-2}$, $PtF_5^-$, $HfF_5^-$, $ZrF_5^-$, $FeCl_4^-$, $CoCl_4^{-2}$, $BF_4^-$, $NiF_4^{-2}$ or $CuCl_4^{-2}$.

18. A process in accordance with claim 15 wherein X is $SbF_6^-$, $PF_6^-$, $TaF_6^-$, $AsF_6^-$, $NbF_6^-$, $VF_6^-$, $SiF_5^-$, $TiF_5^-$, $GeF_5^-$, $SiF_6^{-2}$, $PtF_5^-$, $HfF_5^-$, $ZrF_5^-$, $FeCl_4^-$, $CoCl_4^{-2}$, $BF_4^-$, $NiF_4^{-2}$ or $CuCl_4^{-2}$.

19. A process in accordance with claim 16 wherein X is $SbF_6^-$, $PF_6^-$, $TaF_6^-$, $AsF_6^-$, $Nb_6^-$, $VF_6^-$, $SiF_5^-$, $TiF_5^-$, $GeF_5^-$, $SiF_6^{-2}$, $PtF_5^-$, $HfF_5^-$, $ZrF_5^-$, $FeCl_4^-$, $CoCl_4^{-2}$, $BF_4^-$, $NiF_4^{-2}$ or $CuCl_4^{-2}$.

20. A process in accordance with claim 14 wherein X is $SbF_6^-$, $PF_6^-$, $AsF_6^-$, $HfF_5^-$, $SiF_5^-$, $BF_4^-$, or $FeCl_4^-$.

21. A process in accordance with claim 15 wherein X is $SbF_6^-$, $PF_6^-$, $AsF_6^-$, $HfF_5^-$, $SiF_5^-$, $BF_4^-$, $FeCl_4^-$.

22. A process in accordance with claim 16 wherein X is $SbF_6^-$, $PF_6^-$, $AsF_6^-$, $HfF_5^-$, $SiF_5^-$, $BF_4^-$, or $FeCl_4^-$.

23. A process in accordance with claim 16 wherein said carbon is intercalated with a single salt selected from nitrosyl hexafluoroantimonate or nitronium hexafluoroantimonate.

24. A process in accordance with claim 16 wherein said carbon is intercalated with a single salt selected from nitrosyl hexafluorophosphate or nitronium hexafluorophosphate.

25. A process in accordance with claim 16 wherein said carbon is intercalated with a single salt selected from nitrosyl tetrafluoroborate or nitronium tetrafluoroborate.

26. A process in accordance with claim 15 wherein said carbon is intercalated with two salts selected from $NOBF_4$, $NOSbF_6$, $NOPF_6$, $NO_2BF_4$, $NO_2SbF_6$ or $NO_2PF_6$.

27. A process in accordance with the claim 14 wherein said carbon has the form of a filament electrically oriented along its axis.

28. A process in accordance with claim 15 wherein said carbon has the form of a filament electrically oriented along its axis.

29. A process in accordance with claim 16 wherein said carbon has the form of a filament electrically oriented along its axis.

* * * * *